US007252202B2

(12) United States Patent
Saltzberg et al.

(10) Patent No.: US 7,252,202 B2
(45) Date of Patent: Aug. 7, 2007

(54) CARGO RACK

(75) Inventors: Bruce Saltzberg, Northbrook, IL (US); David Wojtowicz, Orland Park, IL (US); Jeffery L. Lamber, Richton Park, IL (US); Thomas J. St. Germain, Bridgeview, IL (US); Anthony J. Troyner, Shorewood, IL (US); Mitchell E. Bianchin, Villa Park, IL (US)

(73) Assignee: Edsal Manufacturing Co., Inc., Chicago, IL (US)

( * ) Notice: Subject to any disclaimer, the term of this patent is extended or adjusted under 35 U.S.C. 154(b) by 509 days.

(21) Appl. No.: 10/823,198

(22) Filed: Apr. 13, 2004

(65) Prior Publication Data

US 2005/0103734 A1 May 19, 2005

Related U.S. Application Data

(63) Continuation-in-part of application No. 10/715,000, filed on Nov. 17, 2003, now Pat. No. 7,128,225.

(51) Int. Cl.
*A47B 57/00* (2006.01)

(52) U.S. Cl. ..... 211/187

(58) Field of Classification Search ..... 211/187, 211/186, 191, 192, 193, 208
See application file for complete search history.

(56) References Cited

U.S. PATENT DOCUMENTS 5,553,549 A 9/1996 Nilsson
5,749,481 A 5/1998 Miller

OTHER PUBLICATIONS

Standard MR-185 Rack designed by Edsal Manufacturing Co., Inc., as seen in attached documents.
Standard MR-245 Rack designed by Edsal Manufacturning Co., Inc., as seen in attached documents.
Refer to p. 9 of Catalog "Home-E-Quip" Consumer Products div. Edsal Mfg. Co.
Refer to p. 11 of Catalog "Home-E-Quip" Consumer Products div. Edsal Mfg. Co.

*Primary Examiner*—Sarah Purol

(57) ABSTRACT

A cargo rack utilizing structural beams, structural beams used in a framework comprising a plurality of vertical posts with either key shaped apertures or slots and a plurality of horizontal shelving members, structural beams contain either circular apertures when corresponding vertical post contains key shaped apertures or fingers when corresponding vertical post contains slots enabling structural beams to connect to vertical posts, thus allowing horizontal shelving members to be associated with structural beams and vertical posts.

8 Claims, 4 Drawing Sheets

CARGO RACK

This application is a continuation in part from patent application Ser. No. 10/715,000 with a filing date of Nov. 17, 2003 now U.S. Pat. No. 7,128,225. Edsal Manufacturing Co., Inc. is the assignee of this application and application Ser. No. 10/715,000. There are one or more inventors in common between the applications.

BACKGROUND OF THE INVENTION

This invention relates in general to a shelving unit and more particularly to the structural beams in the shelving unit. Several products are similar to this product in that they rely on beams affixed to posts to form a rigid shell that in turn supports shelf members. The same problems and disadvantages associated with prior art disclosed in the original CARGO-RACK patent application nonetheless exist for purposes of this Continuation-in-Part application. Generally, the disadvantages related to inadequate load bearing capacities, over-sized units, multiplicity of components required for assembly along with potential instability of shelving units.

BRIEF SUMMARY OF THE INVENTION

The shelving unit of the present invention preferably includes at least 4 vertical post members mutually spaced from one another. The structural beams are orientated perpendicular to vertical post members and removeably associated therewith taking the form of a parallelogram. The shelving unit is complete when shelf members are removeably associated to the structural beam and vertical post framework.

Acknowledging the same problems and disadvantages associated with the prior art as disclosed in the original CARGO-RACK patent application Ser. No. 10/715000, this Continuation-in-Part CARGO-RACK patent application serves to provide additional assemblies discovered by the inventors to associate the structural beams to the vertical posts. Incorporating these additional methods provides additional means to easily assemble the shelving unit while still minimizing cost per unit, maximizing strength to material weight ratio, and ensuring that cargo will be adequately supported. These features will become more clearly understood upon consideration of the following detailed description and accompanying drawings.

For purposes of clarity, we are herein incorporating by reference the following portions of the parent application filed on Nov. 17, 2003, pages 6-9, and any other parts of the Parent Application that provide support for certain claims of this case:

"The recessed structural beams 2 include a rib 8, with a recessed flange 6, and a return flange 4 as seen in FIG. 5. The rib 8, recessed flange 6, and return flange 4 terminate in a vertical edge of the recessed structural beam 2. The recessed flange 6 is chamfered at the ends of its base 7 in order to enable assembly to appear as seen in FIG. 4 once it has moved along the dashed lines to engage the legs 20, 21 of the vertical post 10."

"The recessed structural beams 30 combine a recessed flange 31 and a return flange 32 as seen in FIG. 13. The recessed flange 31 and return flange 32 terminate in a vertical edge of the recessed structural beam 30. The recessed flange 31 is chamfered at its base 33 in order to enable assembly much in the same way as recessed flange 6 is chamfered at its base 7 on recessed structural beams 2 as shown in FIG. 4 once it has moved along the dashed lines to engage the legs 20, 21 of the vertical post 10."

"The standard structural beams 25 includes a rib 26 formed between an angled standard flange 27 and an angled return flange 28 as seen in FIG. 11. The rib 26, angled standard flange 27, and angled return flange 28 terminate in a vertical edge of the standard structural beam 25. The angled standard flange 27 is chamfered in order to enable standard structural beam assembly to appear as seen in FIG. 10 once it has moved along the dashed lines to engage the legs 20, 21 of vertical post 10."

"Once structural beams 2, 25, or 30 are associated to vertical post 10, it is then possible to removeably associate shelf member 12 to the unit thereby completing the shelving unit 1."

DETAILED DESCRIPTION OF THE PREFERRED EMBODIMENTS

Figure 1:
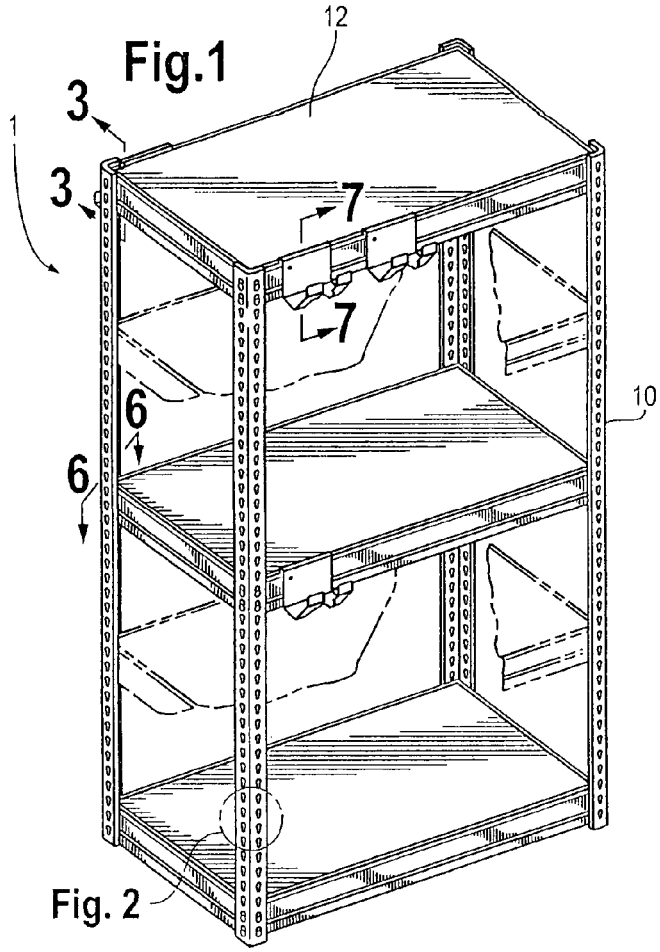
FIG. 1 is an isometric view of the shelving unit.
Figure 14:
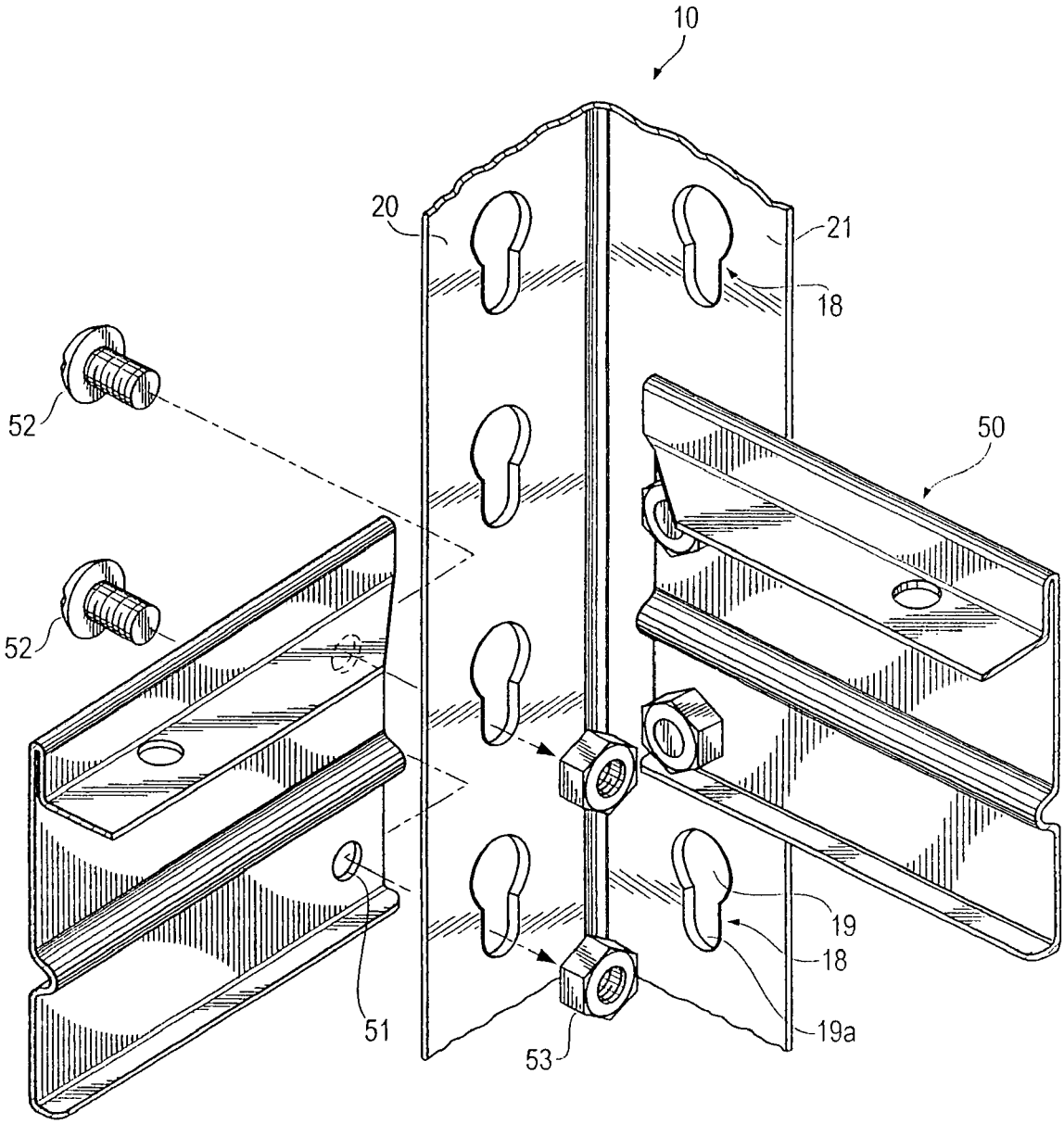
FIG. 14 is a broken/exploded view illustrating the connection of the vertical post and the structural beams incorporating the nut-bolt embodiment.

Referring to FIG. 1, the assembled shelving unit 1 is shown including four vertical posts 10. Each vertical post 10 has a pair of legs 20, 21 perpendicular to one another as shown in FIG. 14. As shown in FIGS. 1 and 14, a plurality of structural beams 50 and horizontal shelving members 12 extend between the pairs of legs 20, 21 on vertical posts 10 and may be attached in a manner that is described below.

The structural beams 50 contain circular apertures 51 which can be seen in FIG. 14. The purpose of circular apertures 51 are to provide means for the structural beams 50 to become associated with vertical posts 10. A pair of the circular apertures 51 are located at each end of structural beam 50. The vertical location of each pair of circular apertures 51 is relative to the vertical distance between the key shaped apertures 18 on legs 20 and 21 on vertical post 10. Furthermore, each pair of circular apertures 51 will be generally proportionate across the vertical centerline of structural beams 50.

Figure 2:
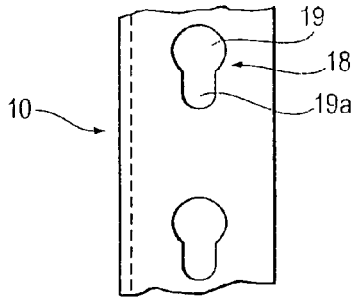
FIG. 2 is a broken view of the apertures on a vertical post.
Figure 3:
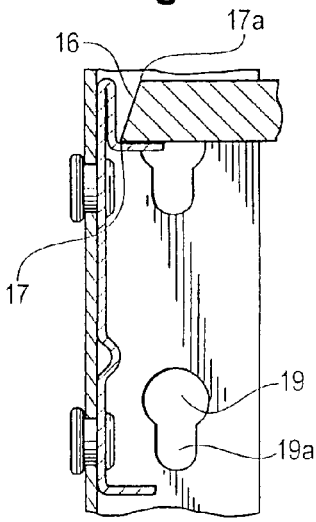
FIG. 3 is a broken view illustrating the connection between the shelving member and the structural beam via the recessed flange.
Figure 4:
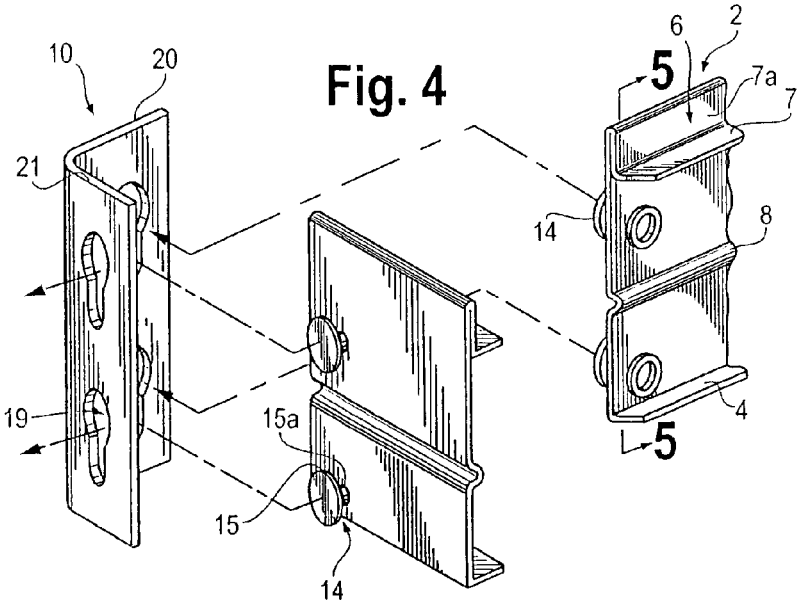
FIG. 4 is an exploded view illustrating the recessed structural beam with ribbing to vertical post assembly via nubs and apertures.
Figure 5:
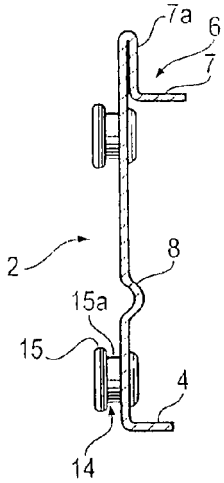
FIG. 5 is a cross sectional view of the profile of the recessed structural beam with ribbing.
Figure 6:
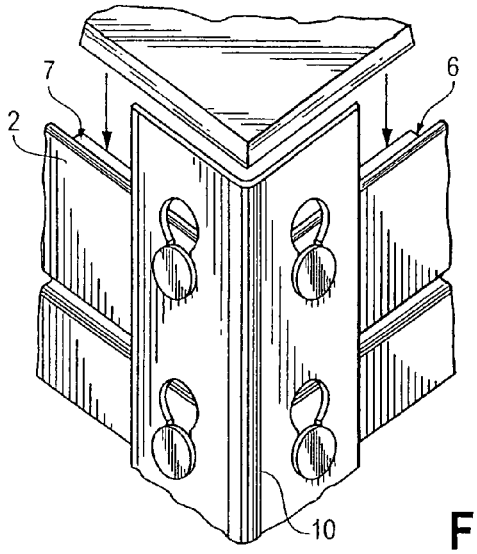
FIG. 6 is a corner view illustrating a shelf member being installed and positioned by the recessed flange.
Figure 7:
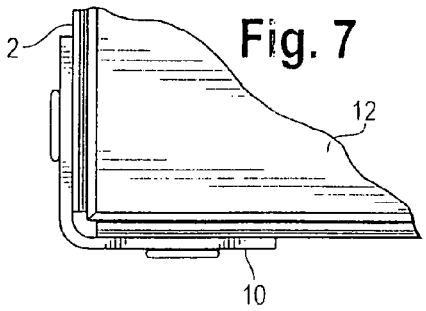
FIG. 7 is a broken top view of the corner of the shelving unit.
Figure 11:
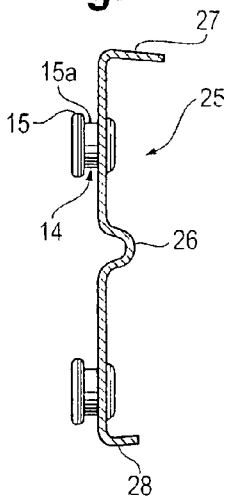
FIG. 11 is a cross sectional view taken along a plane passing through the line 11/11 and looking in the direction of the arrows of the line 11/11 of the standard structural beam.
Figure 13:
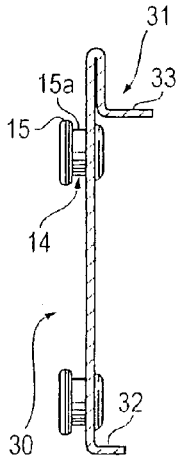
FIG. 13 is a cross sectional profile of the recessed structural beam without ribbing.
Figure 9:
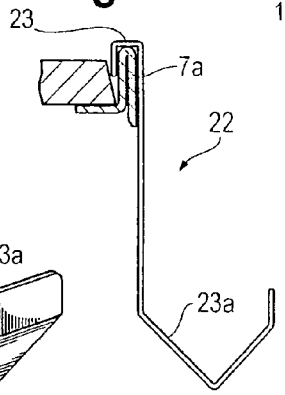
FIG. 9 is the side view of the example profile for the attachment shown in FIG. 8.
Figure 8:
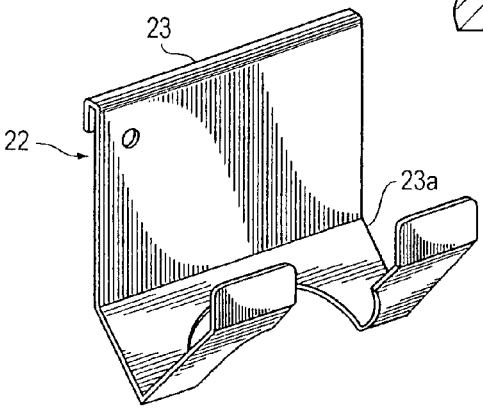
FIG. 8 is a pictorial view of an example of one profile possible with an attachment.
Figure 10:
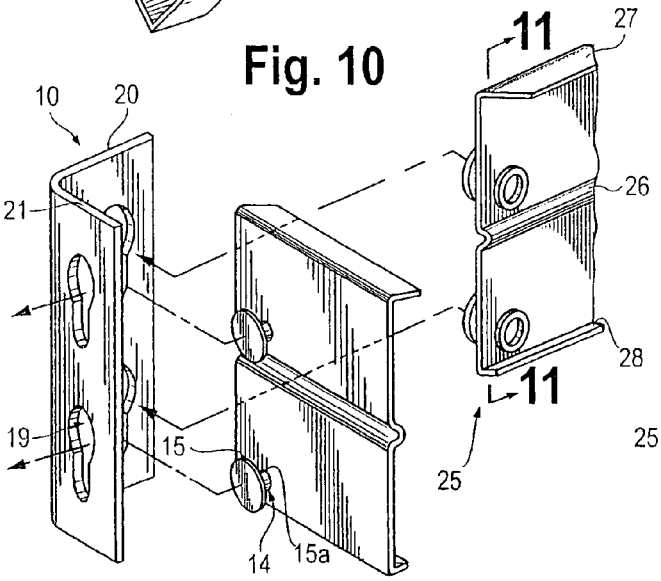
FIG. 10 is an exploded view illustrating a standard structural beam with ribbing being assembled to vertical post via nubs and apertures.
Figure 12:
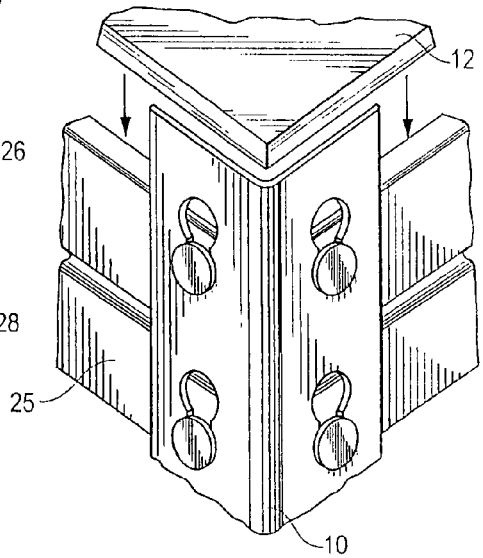
FIG. 12 is a corner view illustrating a shelf member being installed and positioned by the standard beam with ribbing and the angled flange.

As seen in FIGS. 2 and 14, the vertical post 10 is provided with a plurality of key shaped apertures 18 comprising a circular hole 19 with a slot 19*a* that extends downward from the larger circular hole 19.

To assemble the framework, the vertical posts 10 should be orientated in a way such that the legs 20, 21 of each post 10 are aligned with legs 20, 21 of the remaining 3 posts to form a rectangular shape within the legs 20, 21 of all four posts 10. The structural beams 50 can then be removeably associated with vertical posts 10 through the use of screws/bolts 52 and nuts 53 as seen in FIG. 14. In operation, the circular apertures 51 on structural beam 50 should be aligned with the slot 19*a* of key shaped apertures 18 on vertical posts 10. Once aligned, screws/bolts 52 can be inserted through the circular aperture 51 on structural beams 50 and continue through the slot 19*a* of key shaped apertures 18 on vertical posts 10 so that structural beam 50 is in contact with vertical post 10 and the screw/bolt 52 protrudes through the slot 19*a* and past the vertical post 10. To removeably lock the beams 50 to the vertical posts 10, the nut 53 can be fastened to the screw/bolt 52 as seen in FIGS. 14. This process can be repeated until the structural beams 50 are remeoveably attached to the vertical posts 10.

Figure 15:
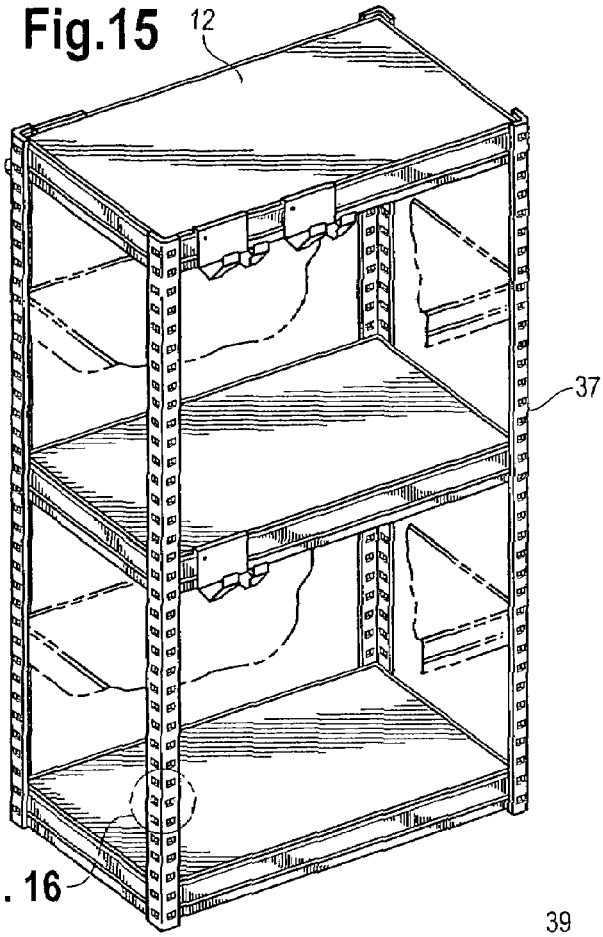
FIG. 15 is an isometric view of the slot embodiment shelving unit.
Figure 16:
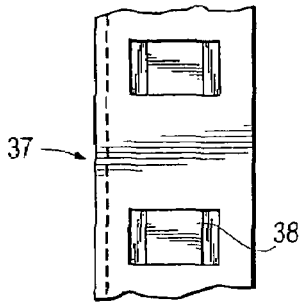
FIG. 16 is a broken view of the slots on a vertical post.
Figure 17:
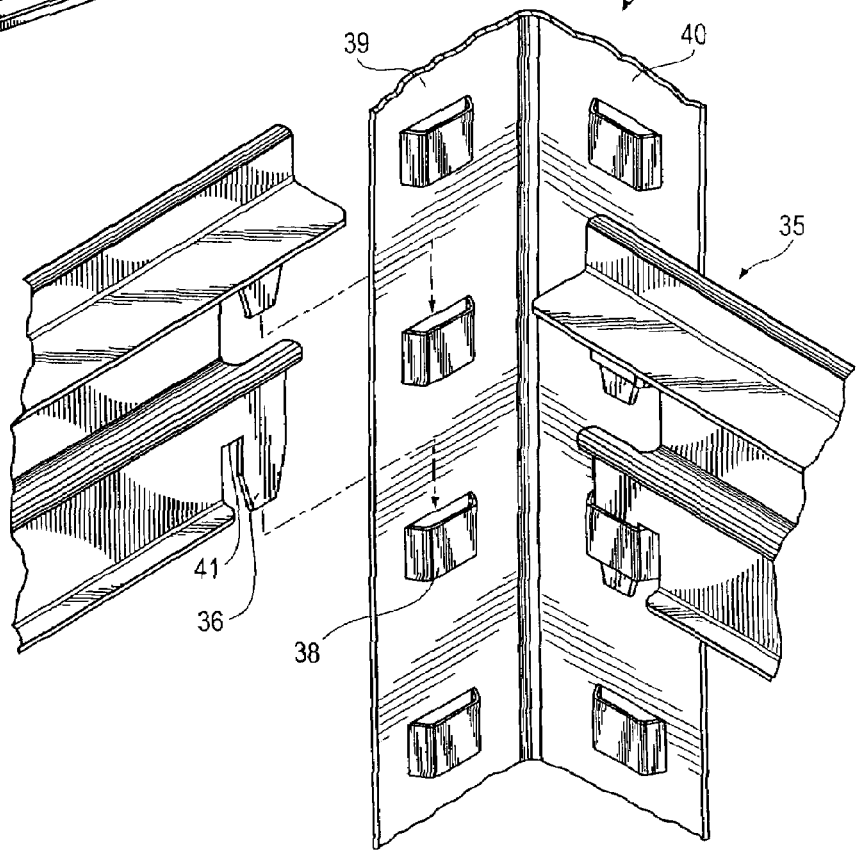
FIG. 17 is a broken/exploded view illustrating the connection of the vertical post and the structural beams incorporating the finger-slot embodiment.

Referring to FIG. 15, the assembled shelving unit 3 is shown including four vertical posts 37. Each vertical post 37 has a pair of legs 39, 40 perpendicular to one another as shown in FIG. 17. A plurality of structural beams 35 and horizontal shelving members 12 extend between the pairs of legs 39, 40 on vertical posts 37 and may be attached in a manner to be described below.

Structural beam 35 is provided with fingers 36 as seen in FIG. 17. The fingers 36 enable structural beam 35 to be associated with the vertical post 37. A pair of fingers 36 are located at each end of structural beam 35. The vertical location of each pair of fingers 36 is relative to the vertical distance between the slots 38 on legs 39 and 40 on vertical post 37. The horizontal location of fingers 36 on structural beams 35 also enable a corner fit between structural beams 35 as shown in FIG. 17. As seen in FIG. 17, the vertical posts 37 are provided with a plurality of slots 38 on legs 39 and 40, along with fingers 36 enable beams 35 to be removeably assembled to the vertical posts 37.

As seen in FIG. 17, the framework is assembled with the vertical posts 37 and are orientated in a way such that the legs 39, 40 of each post 37 are aligned with legs 39, 40 of the remaining 3 posts to form a rectangular shape within the legs 39, 40 of all four posts 37. The structural beams 35 can then be removeably associated to the vertical posts 37 such as seen in FIG. 17. In operation, the fingers 36 are inserted through the respective slots 38 such that the bottom portion of the finger 36 pass through the top portion of the slot 38. The beams 35 become secured to vertical posts 37 when the edge 41 contacts the top of the slot 38 as seen in FIG. 17. This same assembly can be repeated until all structural beams 35 are removeably associated to the vertical posts 37.

It may thus be seen that the objects of the present inventions set forth as well as those made apparent from the foregoing description, are officially obtained. While the preferred embodiments of the invention have been set for purposes of disclosure, modification of the disclosed embodiments of the invention as well as other embodiments thereof may occur to those skilled in the art. Accordingly, the appended claims are intended to cover all embodiments which do not depart from the spirit and scope of the invention.

We claim:

1. A recessed structural beam for use with a storage unit comprising:

a horizontal return flange on the base of said recessed structural beam extending the full length of said recessed structural beam, a rib strategically positioned between said recessed structural beam's base and top, which extends the full length of said recessed structural beam, a recessed flange at top of said recessed structural beam taking the form of "L" shape where the base of said "L" is parallel to the horizontal return flange located at the base of said recessed structural beam, the recessed flange is chamfered at both ends of said recessed structural beam enabling said recessed structural beams to create a corner fit, and a variable number of fingers formed from the ends of said recessed structural beams proportionately located near the base and top in a combination that can enable the assembly of said recessed structural beams to said vertical posts.

2. A recessed structural beam for use with a storage unit comprising:

a horizontal return flange on the base of said recessed structural beam extending the full length of said recessed structural beam, a rib strategically positioned between said recessed structural beam's base and top, which extends the full length of said recessed structural beam, a recessed flange at top of said recessed structural beam taking the form of "L" shape where the base of said "L" is parallel to the horizontal return flange located at the base of said recessed structural beam, the recessed flange is chamfered at both ends of said recessed structural beam enabling said recessed structural beams to create a corner fit, and a variable number of circular apertures on the ends of said recessed structural beams proportionately located near the base and top in a combination that will enable the assembly of said recessed structural beams to said vertical posts.

3. A recessed structural beam for use with a storage unit comprising:

a horizontal return flange on the base of said recessed structural beam extending the full length of said recessed structural beam, a recessed flange at top of said recessed structural beam taking the form of "L" shape where the base of said "L" is parallel to the horizontal return flange located at the base of said recessed structural beam, the recessed flange is chamfered at both ends of said recessed structural beam enabling said recessed structural beams to create a corner fit, and a variable number of fingers formed from the ends of said recessed structural beams proportionately located near the base and top in a combination that will enable the assembly of said recessed structural beams to said vertical posts.

4. A recessed structural beam for use with a storage unit comprising:

a horizontal return flange on the base of said recessed structural beam extending the full length of said recessed structural beam, a recessed flange at top of said recessed structural beam taking the form of "L" shape where the base of said "L" is parallel to the horizontal return flange located at the base of said recessed structural beam, the recessed flange is chamfered at both ends of said recessed structural beam enabling said recessed structural beams to create a corner fit, and a variable number of circular apertures on the ends of said recessed structural beams proportionately located near the base and top in a combination that will enable the assembly of said recessed structural beams to said vertical posts.

5. A standard structural beam for use with a storage unit comprising:

an angled return flange so that the beam forms an acute angle of approximately 85 degrees on the base of said standard structural beam extending the full length of said standard structural beam, a rib strategically positioned between said standard structural beam's base and top, which extends the full length of each of said standard structural beam, a standard angled flange at top of said standard structural beam so that the beam forms an acute angle of approximately 85 degrees at the top of said standard structural beam extending the full length of said structural beam, said angled flange is chamfered at both ends of said standard structural beam enabling said standard structural beams to create a corner fit, and a variable number of fingers formed from the ends of said standard structural beams proportionately located near the base and top in a combination that will enable the assembly of said standard structural beams to said vertical posts.

6. A standard structural beam for use with a storage unit comprising:

an angled return flange wherein said beam forms an acute angle of approximately 85 degrees on the base of said standard structural beam extending the full length of said standard structural beam, a rib strategically positioned between said standard structural beam's base and top, which extends the full length of each of said standard structural beam, a standard angled flange at top of said standard structural beam wherein said that the beam forms an acute angle of approximately 85 degrees at the top of said standard structural beam extending the full length of said structural beam, and said angled flange being chamfered at both ends of said standard structural beam thereby enabling said standard structural beams to create a corner fit, and a variable number of circular apertures on the ends of said standard structural beams proportionately located near the base and top in a combination that will enable the assembly of said standard structural beams to said vertical posts.

7. A recessed structural beam for use with a storage unit comprising:

a horizontal return flange on the base of said recessed structural beam extending the full length of said recessed structural beam, a recessed flange at top of said recessed structural beam taking the form of "L" shape where the base of said "L" is parallel to the horizontal return flange located at the base of said recessed structural beam, the vertically recessed flange is chamfered at both ends of said recessed structural beam enabling said recessed structural beams to create a corner fit, a variable number of mushroom shaped nubs attached to the ends of said recessed structural beam proportionately located near the base and top in a combination that will enable the assembly of said recessed structural beam to said vertical posts.

8. A standard structural beam for use with a storage unit comprising:

an angled return flange so that the beam forms an acute angle of approximately 85 degrees on the base of said standard structural beam extending the full length of said standard structural beam, a rib strategically positioned between said standard structural beam's base and top, which extends the full length of each of said standard structural beam, a standard angled flange at top of said standard structural beam so that the beam forms an acute angle of approximately 85 degrees at the top of said standard structural beam extending the full length of said structural beam, said angled flange is chamfered at both ends of said standard structural beam enabling said standard structural beams to create a corner fit, a variable number of mushroom shaped nubs attached to the ends of said standard structural beam proportionately located near the base and top in a combination that will enable the assembly of the shelf.

* * * * *